US006354921B1

(12) United States Patent
Wood et al.

(10) Patent No.: US 6,354,921 B1
(45) Date of Patent: Mar. 12, 2002

(54) SYSTEM FOR CROSS STREAM REGASSIFIER FOR IMPROVED CHEMICAL MECHANICAL POLISHING IN THE MANUFACTURE OF SEMICONDUCTORS

(75) Inventors: Alexander P. Wood, Fair Oaks Ranch; Oscar L. Caton, Boerne, both of TX (US)

(73) Assignee: VLSI Technology Inc., San Jose, CA (US)

( * ) Notice: Subject to any disclaimer, the term of this patent is extended or adjusted under 35 U.S.C. 154(b) by 0 days.

(21) Appl. No.: 09/299,707

(22) Filed: Apr. 26, 1999

(51) Int. Cl.[7] ..... B24B 57/00

(52) U.S. Cl. ..... 451/64; 451/36; 451/446; 451/559; 210/539; 137/587

(58) Field of Search ..... 137/587; 210/539, 210/540; 451/65, 67, 285, 64, 286, 36, 287, 288, 289, 290, 446, 559

(56) References Cited

U.S. PATENT DOCUMENTS 5,203,698 A * 4/1993 Blake et al.
5,545,074 A * 8/1996 Jacobs ..... 451/40
5,603,655 A * 2/1997 Kaneko et al. ..... 451/450
5,716,264 A * 2/1998 Kimura et al. ..... 451/443
6,071,047 A * 6/2000 Nakai ..... 451/449 X

* cited by examiner

*Primary Examiner*—Timothy V. Eley
(74) *Attorney, Agent, or Firm*—Oppenheimer Wolff & Donnelly LLP

(57) ABSTRACT

An apparatus to induce very small bubbles of gas into a stream of deionized water without allowing large bubbles to be entrained is disclosed for use in Chemical Mechanical Polishing for semiconductor manufacture. The apparatus includes a cylinder possessing a central axis positioned vertically, a gas inlet, a deionized water inlet positioned essentially above the gas inlet, a deionized water with gas outlet positioned essentially above the deionized water inlet and a vent outlet positioned essentially above the deionized water with gas outlet. The apparatus introduces an essentially gaseous composition into the cylinder through the gas inlet into deionized water in the cylinder. The gas travels through the deionized water inlet to a level in the cylinder above the position of the deionized water with gas outlet, wherein the gaseous composition is further constrained to enter as bubbles with a predetermined size range in the deionized water through the deionized water inlet.

15 Claims, 3 Drawing Sheets

SYSTEM FOR CROSS STREAM REGASSIFIER FOR IMPROVED CHEMICAL MECHANICAL POLISHING IN THE MANUFACTURE OF SEMICONDUCTORS

FIELD OF THE INVENTION

The present invention relates generally to semiconductor manufacture and, more particularly, to an improved method for Chemical Mechanical Polishing (CMP) in the manufacture of silicon wafers.

Interconnect structures of integrated circuits (ICs) generally take the form of patterned metallization lines that are used to electrically interconnect devices and to provide interconnection with external circuitry. By way of example, IC devices may include complementary metal oxide semiconductor ("CMOS") devices having diffused source and drain regions that are separated by channel regions, and gates that are located over the channel regions. In practice, an IC chip may include thousands or millions of devices, such as CMOS transistors.

Conventionally, a dielectric layer (e.g., silicon dioxide) is deposited over the devices that are formed on a substrate, and via holes are formed through the dielectric layer to the devices below. As is well known in the art, photolithography "patterning" is typically accomplished by depositing a photoresist layer over the dielectric layer, selectively exposing the photoresist to light through a patterned reticle having via hole patterns, developing the photoresist to form a photoresist via mask, and etching the exposed dielectric layer to form the via holes that lead to a lower level. Once the via holes are formed, a conductive material such as tungsten (W) is used to fill the via holes to define what are known as "tungsten plugs." Once the tungsten plugs are formed, a metallization layer is formed over the dielectric layer and the tungsten plugs. The metallization layer is then patterned using conventional photolithography and plasma etching techniques to define a first level of interconnect metal routing. This process may then be repeated if additional layers of interconnect structures are desired.

To facilitate discussion, a semiconductor substrate will typically have a number of layers fabricated thereon. In this example, the semiconductor substrate has a first dielectric layer deposed over its surface, and a first metallization layer patterned over the first dielectric layer. A second dielectric layer is then deposited over the first dielectric layer and the first metallization layer. Before a second metallization layer is patterned over the second dielectric layer, via holes are etched and filled with a tungsten material to form tungsten plugs. At this point, the second metallization layer is plasma etched to define the desired interconnect lines.

The dielectric layer used to isolate the metal lines forms a conformal coating taking on the surface features of the metal lines. This surface is not planar due to the spaces between the metal lines and causes problems with the focusing of the photolithography process. As the number of levels of interconnects increases, the focusing problem increases. Some methods of selective deposition of dielectric and selective etching have been used to improve the surface feature of the wafer, however, this is a costly and slow process. Also, there are problems with controlling the dielectric thickness and coverage of the metal lines to provide adequate insulation from noise and shorting between levels.

It is obvious that the more planar the surface of the wafer, the smaller the line spacing of the device. A planar surface provides a uniform layer of photoresist on the wafer so the exposure of the photoresist is more constant and controlled. This reduces the variability in the line width and spacing and therefore a more reliable device. The method of planarization of the surface of the wafer must be repeatable, accurate, and not cost prohibitive. It must also provide for the volume of wafers processed and the number of levels that will require planarization.

Because CMOS semiconductor circuits are continuing to decrease in size, and more devices are packed into smaller IC chips, more densely integrated interconnect structures will be required. However, this dense integration has the effect of pushing the limits of conventional photolithography patterning, which necessarily makes photolithography mask misalignments more likely to occur. Of course, when more misalignments occur, more paths will result, thereby increasing the number of exposed tungsten plugs.

Chemical Mechanical Polishing (CMP) is widely used for manufacturing semiconductors. CMP is very effective for planarizing geometries that are not widely isolated. CMP processes planarize the surface of semiconductor wafers to a desired thickness. In a typical CMP process, a wafer attached to a carrier is pressed against a polishing pad in the presence of a slurry. The slurry contains abrasive particles that mechanically remove material from the wafer and chemicals that chemically treat the material that is ultimately polished. Waste material eventually accumulates on the planarizing surface of the polishing pad during planarization which diminishes the pads effectiveness. The waste matter on the pad reduces the effectiveness and the uniformity of the planarizing surface of the polishing pad. The waste matter accordingly reduces throughput of the CMP process and the uniformity of the polished surface on the wafer. Accordingly, it is necessary to periodically clean the planarizing surface of a polishing pad. Planarizing surfaces of polishing pads are conventionally cleaned by brushing the pad with a stiff brush, but U.S. Pat. No. 5,616,069 teaches a method of using a pad scrubber to clean the planarizing surface of a polishing pad used in CMP processing of semiconductor wafers. The pad scrubber has a fluid manifold and a plurality of nozzles coupled to the manifold to clean the pad as it is used in the CMP process. U.S. Pat. No. 5,816,891 discloses a method and apparatus for performing chemical mechanical polishing of oxides and metals using sequential removal on multiple polish platens to increase equipment throughput. U.S. Pat. No. 5,852,497 to the common assignee of this patent application discusses Shallow Trench Isolation (STI) for semiconductor manufacture wherein chemical mechanical polishing (CMP) is utilized to planarize the topography of the alignment marks. Because the polysilicon layer is opaque to the conventional white light source and the HeNe source, and because the alignment marks have been planarized, boundaries between different materials are used to form the alignment marks.

During the manufacture of silicon wafers for use in the fabrication of integrated circuits the wafers must be planarized. CMP is a process to planarize the surface of silicon wafers during production. With CMP, the planarization is accomplished by bringing the surface of the wafer in contact with a polishing pad and introducing a slurry to remove some of the surface. When the process is completed, the surface of the wafer is flat, and the slurry is removed by inducing a slurry rinse fluid, usually Deionized Water. The wafer is then removed from the system to be cleaned and sent on for additional processing. However, due to the flatness of the wafer, the flatness of the pad, and the liquid between the wafer and pad, removal of the wafer may not be successful.

In view of the foregoing, what is desired is an improved method and apparatus for manufacturing silicon wafers that provides for the simple and effective removal of wafers from the pad during the planarization process.

SUMMARY OF THE INVENTION

Broadly speaking, the present invention discloses an apparatus for use in Chemical Mechanical Polishing for semiconductor manufacture, that can induce very small bubbles of gas into a stream of deionized water without allowing large bubbles to be entrained. The apparatus includes a cylinder possessing a central axis positioned vertically, a gas inlet, a fluid inlet positioned essentially above the gas inlet, a fluid and gas outlet positioned essentially above the deionized water inlet and a vent outlet positioned essentially above the fluid and gas outlet. The apparatus introduces an essentially gaseous composition into the cylinder through the gas inlet into a fluid, such as deionized water, in the cylinder. The gas travels through the fluid inlet to a level in the cylinder above the position of the fluid with gas outlet, wherein the gaseous composition is further constrained to enter as bubbles with a predetermined size range in the fluid through the fluid inlet.

Other aspects and advantages of the invention will become apparent from the following detailed description, taken in conjunction with the accompanying drawing, illustrating by way of example the principles of the invention.

DESCRIPTION OF THE DRAWINGS

The foregoing and other objects, aspects and advantages are better understood from the following detailed description of a preferred embodiment of the invention with reference to the drawings, in which.

DETAILED DESCRIPTION

Figure 1:
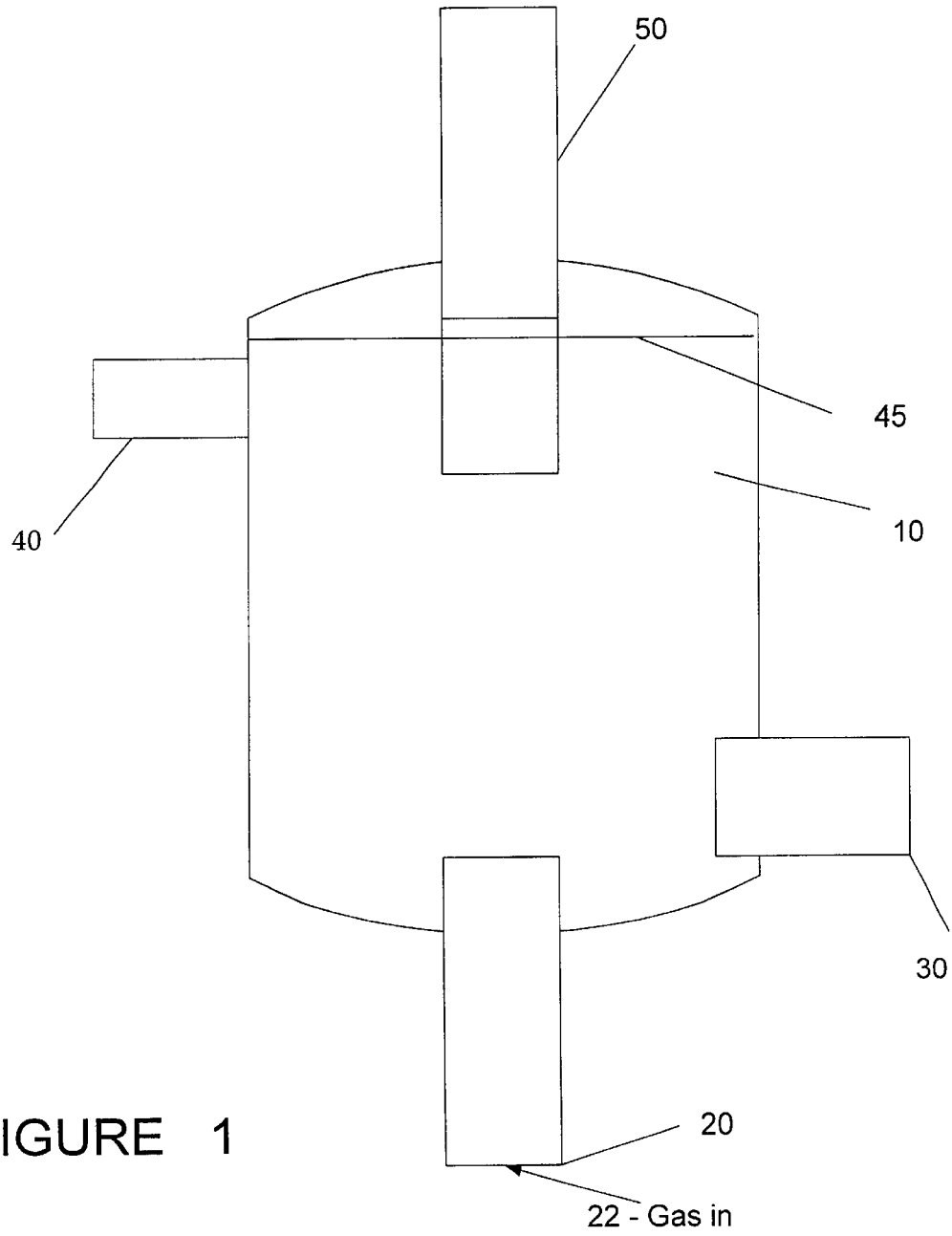
FIG. 1 is a regassifier in accordance with a preferred embodiment.

An improved method and apparatus for manufacturing silicon wafers that provides for the simple and effective removal of wafers from the pad during the planarization process is presented. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

The objectives of the semiconductor industry are to continually improve the performance of silicon devices, while maintaining or decreasing the cost of these devices. The ability to manufacture silicon chips, exhibiting sub-micron features, have in part, allowed the performance and cost objectives to be realized. For example silicon devices, fabricated with specific sub-micron features, result in larger decreases in performance degrading resistance and capacitance, then counterparts fabricated using less aggressive designs. In addition the ability to produce smaller silicon chips, due to the use of smaller features, allows more chips to be produced from a specific size starting silicon substrate. Since the processing cost for the silicon substrate remains the same, the cost of an individual silicon chip is reduced.

In a typical CMP process, a wafer attached to a carrier is pressed against a polishing pad in the presence of a slurry. The slurry contains abrasive particles that mechanically remove material from the wafer and chemicals that chemically treat the material that is ultimately polished. Waste material eventually accumulates on the planarizing surface of the polishing pad during planarization which diminishes the pads effectiveness. The waste matter on the pad reduces the effectiveness and the uniformity of the planarizing surface of the polishing pad. The waste matter accordingly reduces throughput of the CMP process and the uniformity of the polished surface on the wafer. Thus, it is necessary to periodically clean the planarizing surface of a polishing pad. Planarizing surfaces of polishing pads are conventionally cleaned by brushing the pad with a stiff brush. Chemical Mechanical Polishing (CMP) is widely accepted for polishing semiconductor wafers. Both oxide CMP and metal CMP are used, respectively, on oxide and metal surfaces supported over a semiconductor substrate.

Oxide CMP is employed to convert a conformal oxide layer deposited on a layer of patterned metal, into a planar oxide surface. Without oxide CMP, the conformal oxide layer conforms to the shape of the layer of patterned metal. Fluctuations in the surface of the conformal oxide layer exist above metal steps in the layer of patterned metal. With oxide CMP, oxide on the surface of a wafer is removed, producing a planar layer of oxide above the metal steps. Accordingly, a second layer of metal deposited on the surface of the planar layer of oxide, will also have a planar surface. Metal CMP is employed to convert a conformal metal layer deposited on a layer of patterned oxide, into a planar metal/oxide surface. This planar metal/oxide surface then comprises metal structures surrounded by other materials. Local planarity corresponds to providing planarization over small regions of the wafer surface, while global planarity corresponds to providing planarization over the entire wafer surface.

The challenge involved with performing metal CMP is quite different than for oxide CMP. For oxide CMP, polishing stops on oxide and the goal is to achieve global and local planarity across the semiconductor wafer surface. For metal CMP, polishing stops partly on metal and partly on oxide. The goal is to achieve a planar surface on each of the metal structures which is flush with the surrounding field oxide regions.

Existing oxide CMP tools include tools that offer single wafer processing with a single wafer-carrier head, double wafer processing with dual wafer-carrier heads and multiple wafer processing with multiple wafer-carrier heads. Each process cycle can only process a wafer or set of wafers equivalent to the number of wafer-carrier heads on the tool. All existing oxide CMP tools are configured to process one wafer, two wafers, or multiple wafers using a single polish platen. Current state of the art oxide CMP tools can process one, two or up to five to six wafers simultaneously on a single polish platen. A large polish platen is employed to accommodate more than one wafer.

In accordance with the invention, a chemical mechanical polisher is provided with increased throughput. Chemical mechanical polishing of oxide is performed by sequential polishing using multiple polish platens and a single polish platen polishes a fraction of the total oxide removal target. (Total oxide removal target refers to the total amount of oxide to be removed from a wafer during one complete CMP process cycle.) Total oxide removal is achieved after completing polishing on all available polish platens assigned for polishing. The amount of oxide removed on each polish platen depends on the number of polish platens, slurry supply and polishing pad. Thus, both the polishing slurry and polishing pad material can be different for each polish platen. This degree of freedom adds tremendous manufacturing flexibility in metal CMP.

For metal CMP, the factors affecting polishing rate, non-uniformity, planarity, dishing of metal structures, erosion of field oxide, and finishing surface quality of metal and field oxide, are secondarily related to equipment parameter settings. Both polishing slurry and pad need to be compatible with the material to be polished in order to achieve the best results. Still another common use for metal CMP is to form tungsten plugs which serve as contacts and vias between two layers of aluminum metal. Slurry and polishing pad material can be substituted for each polish platen, which is especially important when dealing with aluminum, copper or other metals. Different polishing pads may be beneficial for metal CMP as a softer pad can be used in the first polish platen to allow fast removal of bulk metal material, and then a stiffer polishing pad can be used in the polishing process. It is well-known in the art of oxide CMP that oxide removal rate decreases with longer polish time and higher oxide removal, i.e., the amount of oxide removed. The oxide removal rate is highest on a freshly conditioned polish pad.

During the manufacture of silicon wafers for use in the fabrication of integrated circuits the wafers must be planarized. CMP is a process to planarize the surface of silicon wafers during production. With CMP, the planarization is accomplished by bringing the surface of the wafer in contact with a polishing pad and introducing a slurry to remove some of the surface. When the process is completed, the surface of the wafer is relatively flat, and the slurry is removed by inducing a slurry rinse fluid, such as deionized water. The wafer is then removed from the system to be cleaned and sent on for additional processing. However, due to the flatness of the wafer, the flatness of the pad, and the liquid between the wafer and pad, removal of the wafer may not be successful.

A preferred embodiment provides an apparatus to induce very small bubbles of gas into a stream of deionized water without allowing large bubbles to be entrained. FIG. 1 illustrates a regassifier in accordance with a preferred embodiment. The apparatus includes a cylinder possessing a central axis positioned vertically 10 and further including a gas inlet 20, a deionized water inlet 30 positioned essentially above the gas inlet, a fluid with gas outlet 40 positioned essentially above the deionized water inlet 30 and a vent outlet 50 positioned essentially above the fluid with gas outlet 40. The novel apparatus introduces an essentially gaseous composition 22 into the cylinder 10 through the gas inlet 22, by introducing a fluid, such as deionized water into the cylinder through the fluid inlet 30 to a level in the cylinder 45 above the position of the fluid with gas outlet 40, wherein the gaseous composition 22 upon entry through the gas inlet 20 is further constrained to enter as bubbles with a predetermined size range in the fluid through the fluid inlet 30.

The planarization is accomplished by bringing the surface of a wafer in contact with a polishing pad and introducing the gaseous slurry from the fluid with gas outlet 40 to work in conjunction with the pad to remove some of the surface. When the process is completed, the surface of the wafer is relatively flat, and the slurry is removed by inducing a slurry rinse fluid, such as deionized water. The wafer is then removed from the system to be cleaned and sent on for additional processing. However, since the wafer is flat, the pad is flat and the liquid between the wafer and the pad is relatively flat, removal of the wafer may not be successful.

Thus, the apparatus of FIG. 1 introduces very small bubbles of a gas, such as helium, argon, nitrogen or air into a stream of fluid, such as deionized water, without allowing large gas bubbles to become entrained in the water stream to create other problems. The very small bubbles facilitate the dissolving of the gas into the water stream. The dissolved gas provides the media to break the vacuum between the wafer and the pad when the wafer is removed. The result is a repeatable extraction of the wafer from the pad. During the process, the gas dissolved in the fluid does not present a problem since there are not any gas bubbles or voids in the fluid streams to promote the drying of the gaseous slurry being rinsed away.

With reference to FIG. 1, the regassifier allows the fluid to enter the main chamber at the lower side of the chamber 30. The gas is induced through a sintered stainless steel filter 20 with a pore size of less than one micron at the bottom of the chamber. This action generates a large number of very small bubbles in the water stream which quickly dissolve into the water. The water continues to travel up through the chamber and exits through the side of the chamber 40. Any excess gas that does not dissolve in the water is collected at the top of the chamber and is vented from the chamber 50.

The venting system design is a self-regulating system. As the amount of gas to be removed from the system increases, more of the venting system is exposed allowing the gas to escape from the chamber. When the gas is removed from the system, the water covers more of the venting media that reduces the volume of gas contained in the chamber. This characteristic makes the chamber insensitive to changes in the amount of gas that does not dissolve into the water.

To maintain the proper pressure of the gas to water, the gas pressure is controlled by a dome-loaded regulator with the loading pressure provided by the water pressure. Therefore the differential pressure between the gas and the water is constant. A preferred embodiment provides a slurry rinse fluid 40 having a small amount of dissolved gas to the CMP machine to promote the wafer removal of the pad. When the wafer is removed from the pad, a small vacuum created by lifting the wafer from the pad draws the gas out of the solution. This gas is then freed to move in the liquid and eliminate the force holding the wafer to the pad.

Figure 2:
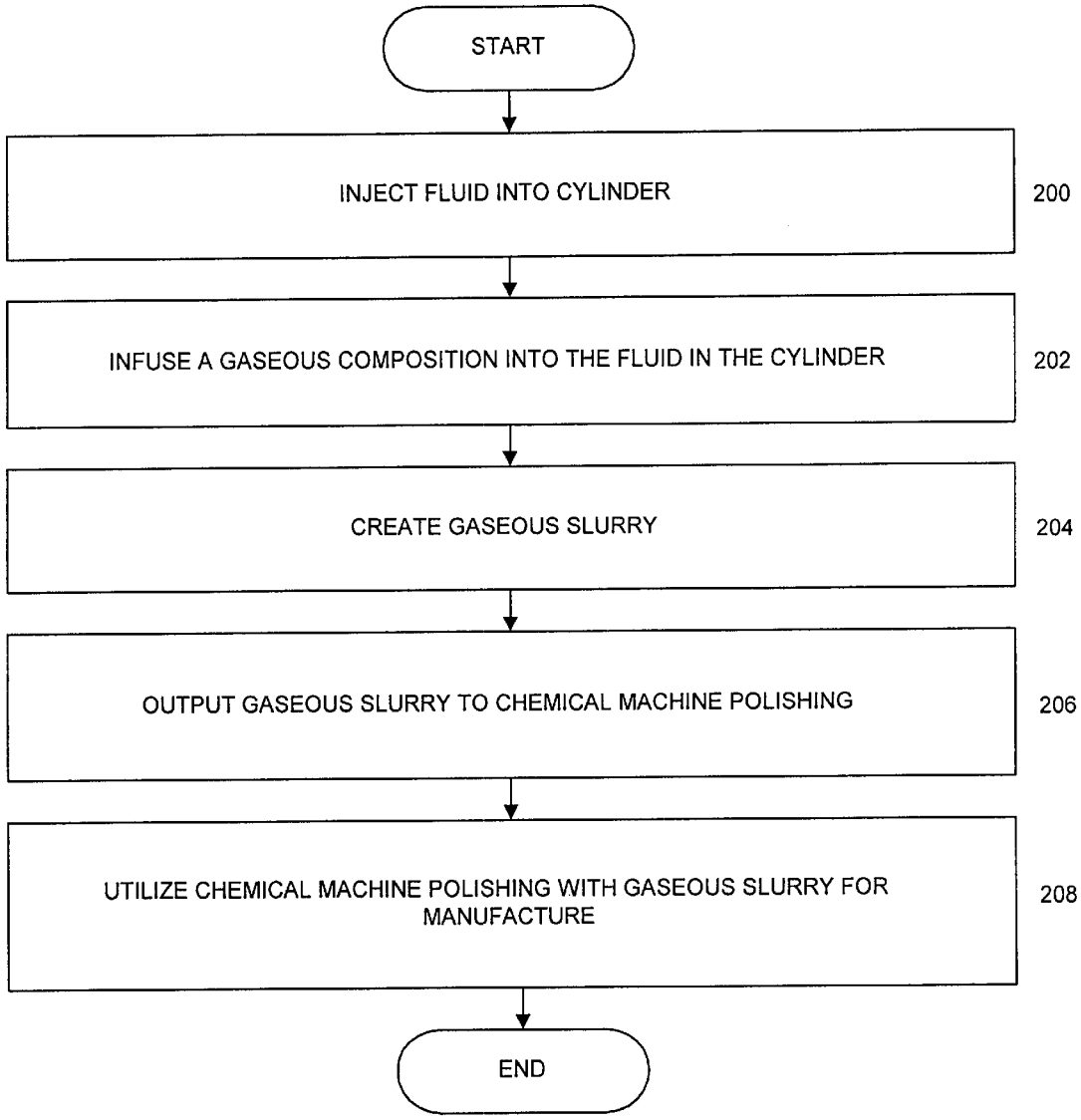
FIG. 2 is a flowchart of a method in accordance with a preferred embodiment.

FIG. 2 is a flowchart of a method in accordance with a preferred embodiment. Processing commences at function 200 when the deionized water or other fluid is injected into the cylinder as described above. Next, in function block 202 a gaseous fluid is infused into the cylinder through for example a filter to regulate the size of the bubbles that the gaseous fluid create in the fluid in the cylinder. Then, at function block 204 a gaseous slurry is formed in the cylinder and is output through the side of the chamber 40 of FIG. 1. In accordance with a preferred embodiment, the gaseous slurry is utilized in Chemical Machine Polishing (CMP) for semiconductor manufacture as described in function block 208 and detailed in FIG. 3.

Figure 3:
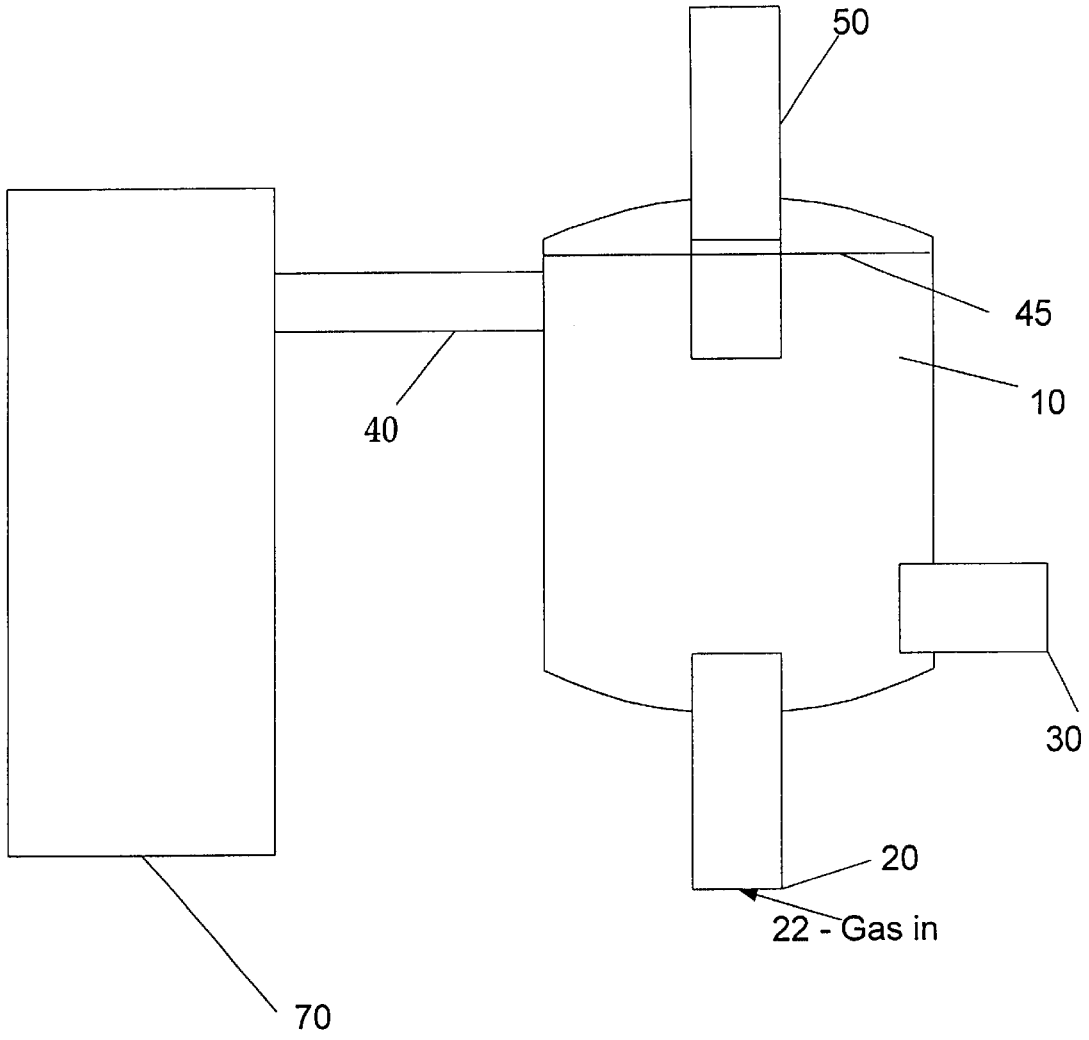
FIG. 3 is a system diagram in accordance with a preferred embodiment.

FIG. 3 is a system diagram in accordance with a preferred embodiment. A preferred embodiment provides an apparatus to induce very small bubbles of gas into a stream of deionized water without allowing large bubbles to be entrained and utilized to form a gaseous slurry to improve Chemical Machine Polishing (CMP) for semiconductor manufacture. The apparatus includes a cylinder possessing a central axis positioned vertically 10 and further including a gas inlet 20, a fluid inlet 30 positioned essentially above the gas inlet, a fluid with gas outlet 40 positioned essentially above the fluid inlet 30 and a vent outlet 50 positioned essentially above the fluid with gas outlet 40. The novel apparatus introduces an essentially gaseous composition 22 into the cylinder 10 through the gas inlet 22, by introducing fluid into the cylinder through the fluid inlet 30 to a level in the cylinder 45 above the position of the fluid with gas outlet 40, wherein the gaseous composition 22 upon entry through the gas inlet 20 is further constrained to enter as bubbles with a predetermined size range in the fluid through the fluid inlet 30. The gaseous outlet 40 is fed into a Chemical Machine Polishing (CMP) operation 70 for use in semiconductor manufacturing in accordance with a preferred embodiment.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus to induce very small bubbles of gas into a stream of deionized water, comprising:

a cylinder possessing a central axis positioned vertically and further comprised of a gas inlet, a deionized water inlet positioned essentially above the gas inlet, a deionized water with gas outlet positioned essentially above the deionized water inlet and a vent outlet positioned essentially above the deionized water with gas outlet, wherein:

an essentially gaseous composition enters the cylinder through the gas inlet;

deionized water enters the cylinder through the deionized water inlet, filling the cylinder to above the position of the deionized water with gas outlet; and said essentially gaseous composition upon entry through the gas inlet is further constrained to enter as bubbles in the deionized water which has entered through the deionized water inlet.

2. An apparatus to induce very small bubbles of gas into a stream of deionized water as recited in claim 1, wherein the apparatus includes a filter to constrain the size of the bubbles.

3. An apparatus to induce bubbles of gas into a stream of fluid, comprising:

a cylinder possessing a central axis positioned vertically and further comprised of a gas inlet, a fluid inlet positioned essentially above the gas inlet, a fluid with gas outlet positioned essentially above the fluid inlet and a vent outlet positioned essentially above the fluid with gas outlet, wherein an essentially gaseous composition enters the cylinder through the gas inlet;

fluid enters the cylinder through the fluid inlet, filling the cylinder to above the position of the fluid with gas outlet; and said essentially gaseous composition upon entry through the gas inlet is further constrained to enter as bubbles in the fluid which has entered through the fluid inlet.

4. An apparatus to induce very small bubbles of gas into a stream of deionized water as recited in claim 3, wherein the apparatus includes a filter to constrain the size of the bubbles.

5. The apparatus as recited in claim 4 wherein the fluid entering the cylinder is water.

6. The apparatus of claim 3, wherein the fluid entering the cylinder provides partial diffusion of bubbles.

7. The apparatus of claim 3, wherein the gaseous composition entering the cylinder is helium.

8. The apparatus of claim 3, wherein the gaseous composition entering the cylinder is argon.

9. The apparatus of claim 3, wherein the gaseous composition entering the cylinder is nitrogen.

10. The apparatus of claim 3, wherein the gaseous composition entering the cylinder is air.

11. The apparatus of claim 3, wherein the gas inlet further includes a filter having a pore size regulating the size of the bubbles.

12. The apparatus of claim 3, wherein the filter is stainless steel.

13. The apparatus of claim 3, wherein the cylinder includes a dome loaded regulator to control the pressure of the gas to water.

14. The apparatus of claim 3, wherein the cylinder includes a venting system to release from the cylinder excess gas.

15. The apparautus of claim 3, wherein the venting system is self regulating.

* * * * *